United States Patent [19]

Eroncig

[11] 4,097,867

[45] Jun. 27, 1978

[54] HELICAL ANTENNA ENCASED IN FIBERGLASS BODY

[76] Inventor: James Joseph Eroncig, 6400 SW. 145th Ter., Miami, Fla.

[21] Appl. No.: 615,917

[22] Filed: Sep. 23, 1975

[51] Int. Cl.[2] ..... H01Q 1/32; H01Q 1/36

[52] U.S. Cl. ..... 343/715; 343/750; 343/895

[58] Field of Search ..... 343/749, 750, 873, 895, 343/715

[56] References Cited

U.S. PATENT DOCUMENTS

| | | | |
|---|---|---|---|
| 2,763,003 | 9/1956 | Harris | 343/895 |
| 2,966,679 | 12/1960 | Harris | 343/895 |
| 3,082,134 | 3/1963 | Wentz | 343/872 |
| 3,172,109 | 3/1965 | Senrui | 343/749 |
| 3,400,403 | 9/1968 | Spilsbury | 343/750 |
| 3,543,275 | 11/1970 | Wendell | 343/750 |
| 3,828,353 | 8/1974 | Majkrzak et al. | 343/895 |

*Primary Examiner*—Eli Lieberman
*Attorney, Agent, or Firm*—Gipple & Hale

[57] ABSTRACT

A method of forming a top-loaded waveguide for radio antennas and the structure of said waveguide comprising the steps of helically winding a wire around a removable mandrel, encasing said mandrel and wire with impregnated fiberglass, encasing said mandrel, wire, and fiberglass with a sheath, liquefying the fiberglass by heating such that the wire is encapsulated by the fiberglass, and removing the mandrel. Top and bottom ferrules are provided for electrically connecting the ends of the wire.

2 Claims, 5 Drawing Figures

HELICAL ANTENNA ENCASED IN FIBERGLASS BODY

BACKGROUND OF THE INVENTION

The present invention relates to an antenna structure and a method of forming waveguides for radio antennas and particularly those for use in the reception of ultra short waves in the twenty-seven magehertz band, commonly referred to as citizens band.

Radio waveguides, antennas or aerials are as old as radio itself and many such devices have been described in prior art. Some such prior art devices are set forth in U.S. Pat. Nos. 2,706,366; 3,106,768 and 3,261,078. However, in the recent development and popularization of ultra short wave receivers or citizens band radios, the traditional type of cylindrical metal antenna has given way to types formed of lighter and more resilient material. Ultra short waves travel in straight paths and therefore the reception is impeded by various earth born obstacles. For this reason, it is desirable to have the effective cylindrical waveguide portion of the antenna as far above the earth as practical. This requires an extended support structure for the waveguide; however, because the antenna is frequently mounted on a vehicle or is otherwise readily portable, its support structure must be strong, light and resilient as it is subjected to the forces of wind, velocity, etc. In previous attempts to make an antenna that is light weight and resilient, plastic materials have been utilized for the support structure; however, the coil or waveguide portion of the antenna, because it is relatively heavy, has necessarily been positioned near the bottom of the supporting structure so that the antenna would not be top heavy and tending to break off at the base when subjected to wind or other forces. Such a base loaded antenna provides the requisite lightness and resiliency but does not carry the waveguide portion of the antenna high enough above the surface of the earth to produce maximum reception of the ultra short waves. Antennas which succeed in projecting the waveguide portion further upward, having generally required heavier supporting structure or a complex method of manufacture which involved multiple processes and the use of nonmetallic reinforcements. Metallic reinforcements could not be added to the support structure since they would interfere with the electromagnetic functioning of the antenna. It is the object of the present invention to provide and produce a strong light-weight and resilient antenna bearing its waveguide portion toward its top end and to do so in a simple, inexpensive manner utilizing the strength of the conductive wire as an element of reinforcement.

BRIEF DESCRIPTION OF THE DRAWINGS

As shown in FIG. 1, a preformed steel mandrel 2 is employed which varies in size depending upon the desired thickness, length and tapering of the resultant antenna which is manufactured. An electrically conductive wire 4 is wrapped around the mandrel 2 in relatively elongated coils from the top portion toward the bottom portion of the mandrel 2. At the upper end 3 of the mandrel 2 the wire 4 is wrapped in a relatively tight coil or waveguide portion 6. The wire 4 extends beyond the bottom portion 5 of the mandrel 2 and beyond the top portion 3 of the mandrel 2. Both ends of the wire 4 are secured to the mandrel 2 by wire securing means 8 in the form of cellophane tape to hold the wire in place and taut against the mandrel. It should be noted that suitable adhesive can be used in place of the cellophane tape without departing from the spirit of the invention. With the wire 4 thus secured against the tapered mandrel 2, a fiberglass cloth 10 impregnated with epoxy or polyester resin is wrapped around the wire 4. The impregnated fiberglass 10 is precut in conformity to the shape of the mandrel 2 so that when it is wrapped around the mandrel its two side edges 11 and 12 meet and form a tapered cylinder consistent with the shape of the mandrel. With the fiberglass cloth 10 wrapped around the mandrel and enclosing the coiled wire 4 and waveguide portion 6, it is secured in place by a cellophane cover 30 which can be either a wrapping of cellophane ribbon or a sheath of cellophane which has been preformed in conformity with the shape of the dimension of the mandrel. With the impregnated fiberglass cloth 10 held in place by the cellophane cover or sheath of the mandrel 2, the entire structure is cured or baked in an oven at a temperature of approximately 350° fahrenheit for forty 5 minutes. The heat liquifies the impregnated cloth 10 which causes it to merge with the cellophane sheath and thereby totally surround and encapsulate the coiled wire 4. The upper and lower end of the wire 4 extend beyond the impregnated fiberglass cloth as shown in FIG. 1. After heating the entire structure is cooled at which point the impregnated fiberglass cloth 10 and cellophane sheath 30 solidifies. The steel mandrel 2 is now removed, leaving a hollow fiberglass antenna 13, with a smooth exterior surface, encasing the coiled wire 4 including the waveguide portion 6. The smooth external surface of the antenna is formed by the cellophane sheath merging with the fiberglass during heating. This smooth exterior surface eliminates any costly machining step inherent in the prior art. The partially encapsulated waveguide portion 6 functions to intercept ultra short waves and transmit them through the wire 4 to a radio receiver. The wire 4 functions not only to transmit the radio waves but also to reinforce and strengthen the antenna structure. The metal wire and solidified fiberglass structure function in a symbiotic type relationship with respect to strengthening the structure. The metal windings import considerable strength and rigidity to the fiberglass due to the fact that the windings are totally surrounded and encapsulated within the fiberglass. Additionally, the fiberglass adds considerable strength and flexibility to the metal windings. The increased strength thus imparted to the antenna structure is extremely important in that it allows top-loaded antennas to be used on moving vehicles which are subject to extremely high whipping and bending due to wind and other external forces. With the antenna thus formed, a base ferrule 14 is applied to the bottom portion of the antenna and the bottom end of the wire 4 is soldered or otherwise connected electrically to the base ferrule 14. A top ferrule 16 is applied to the upper end of the antenna and the upper end of the wire 4 is soldered or otherwise electrically connected to the top ferrule 16. The top ferrule 16 is provided with an aperture 20 through which tuning shaft 18 extends and the tuning shaft 18 may be moved upwardly or downwardly within the cavity of top ferrule 16 until its optimum position is determined. The top ferrule 16 is also provided with a locking mechanism 22 shown in FIG. 4 in the form of a set screw to secure the tuning shaft 18 in its optimum positioon.

From the above it will be understood that an antenna is formed of strong, light-weight resilient fiberglass in which the coiled wire 4 not only forms the electromagnetic waveguide portion 6 but also in connecting that waveguide portion to the radio receiver provides reinforcement in the fiberglass supporting structure of the antennas.

Figure 1:
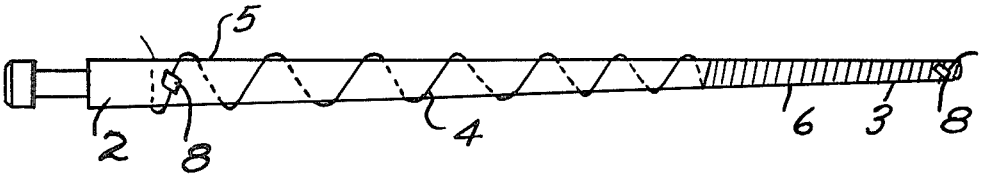
FIG. 1 is a side elevational view of a mandrel with helical wire wrapped around it.
Figure 2:
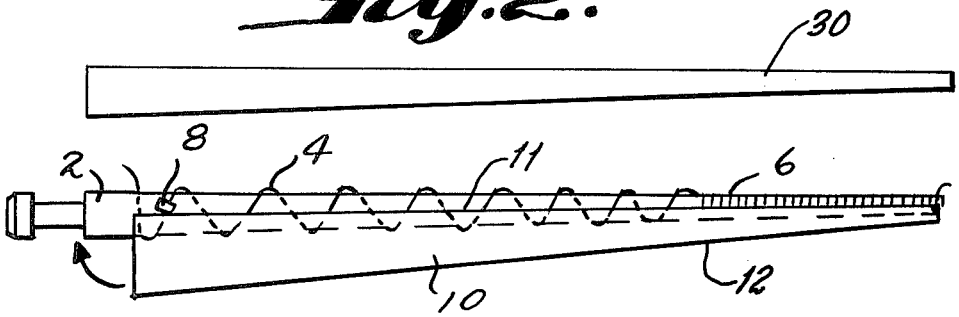
FIG. 2 is a side elevational view of a mandrel with a wire wrapped around it and a fiberglass cloth secured thereto with the cellophane sheath shown before being placed over the assembly.
Figure 3:
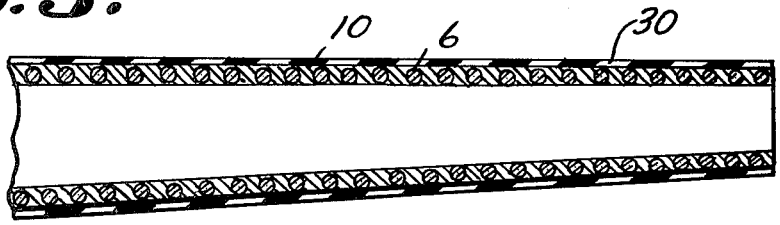
FIG. 3 is a cross-sectional view of the fiberglass sheath and wires after heating.
Figure 4:
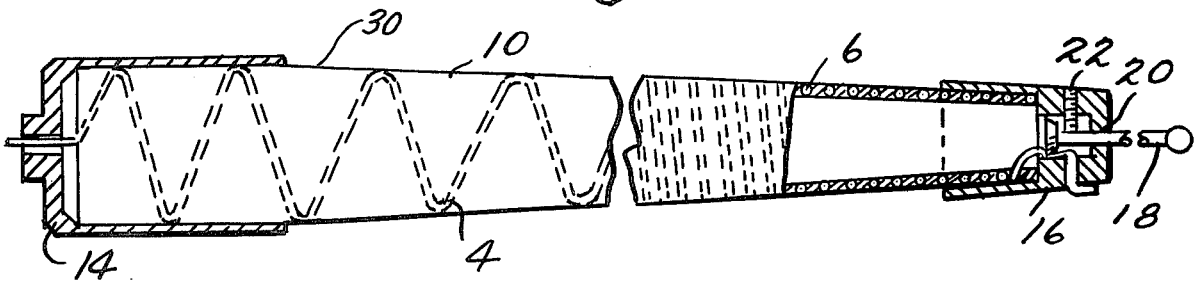
FIG. 4 is a cross-sectional view of the preferred embodiment of the antenna structure.
Figure 5:
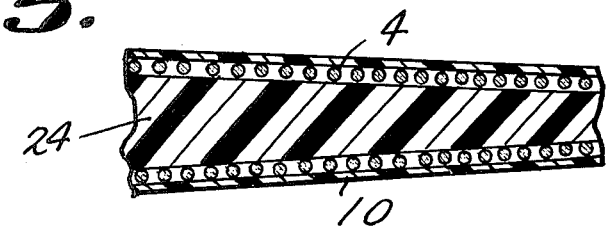
FIG. 5 is a cross-sectional view of the solid mandrel with the helical wires shown prior to heating.

A variation of the invention is shown in FIG. 5 wherein the mandrel 24 is formed of fiberglass which has been preformed and shaped to the desired length and tapering of the antenna. In this variation, the impregnated fiberglass cloth 10 is wrapped around the wire 4 on the fiberglass mandrel. The structure is then cured as described above. However, in this variation the mandrel is not removed but remains in place and becomes a permanent part of the antenna structure. This variation produces an antenna of outstanding strength and resiliency where such qualities are desired even at the expense of the added weight.

What is claimed is:

1. A wave guide antenna comprising a hollow fiberglass antenna body encapsulating and totally surrounding a coiled electrically conductive top-loaded wire, said coiled wire being tightly would in helical coils at the top end of said antenna body and increasing in spacing distance between the helical coils as the coils approach the bottom end of said antenna body to provide for interception of ultra short waves, said encapsulated helical wires serving to provide strength to said fiberglass antenna body, a cellophane sheath surrounding and merged into the exterior surface of said fiberglass antenna body, said sheath providing a smooth exterior surface to said antenna, a base ferrule secured to the bottom end of said antenna and electrically connected to the end of wire proximate thereto, a top ferrule secured to the top end of said antenna body and electrically connected to the other end of wire proximate thereto, said top ferrule being provided with a locking mechanism adapted to secure a tuning shaft in an optimum position, said tuning shaft being slideably adjustable along the central axis of said antenna body and being in direct electrical contact with said top ferrule.

2. A waveguide antenna comprising a hollow fiberglass antenna body completely surrounding a coiled metal wire helically wound and totally contained within said antenna body, said coiled metal wire being tightly wound at the top end of said antenna body and increasing in spacing distance between the helical coils as said coils approach the bottom end of said antenna body, said coiled metal wire providing a metal structure for the interception of transmitted ultra short waves, said helical wires providing strength and rigidity to said fiberglass body, said fiberglass body providing strength and flexibility to said coiled metal wire, a cellophane sheath surrounding said fiberglass body and merged therewith, said sheath providing a smooth exterior surface to said antenna body, a base ferrule secured to the bottom end of said antenna body, said base ferrule providing a central aperture for allowing the bottom end of said wire to pass therethrough, and an electrically conductive top ferrule secured to the top end of said antenna body being electrically connected to the top end of said metal wire, said top ferrule being further provided with a slideably adjustable electrically conductive tuning shaft, said tuning shaft being slideable with a centrally aligned aperture of said top ferrule, said tuning shaft being in electrical contact with said top ferrule and a locking screw which serves to lock said shaft in an optimum tuned position.

* * * * *